United States Patent [19]

Vazin

[11] Patent Number: 4,469,143

[45] Date of Patent: Sep. 4, 1984

[54] TANK TRUCK PURGING SYSTEM

[75] Inventor: Gholam R. Vazin, Westminster, Calif.

[73] Assignee: Chevron Research Company, San Francisco, Calif.

[21] Appl. No.: 349,171

[22] Filed: Feb. 16, 1982

[51] Int. Cl.[3] ..... B08B 3/04; B08B 9/00

[52] U.S. Cl. ..... 141/1; 134/22.1; 134/22.18; 134/10; 134/104; 134/109; 134/166 R; 141/85

[58] Field of Search ..... 141/1, 85, 89; 134/104, 134/109, 166 R, 171, 22.1, 22.68, 40, 10; 210/170, 523; 55/421

[56] References Cited

U.S. PATENT DOCUMENTS

| | | | |
|---|---|---|---|
| 3,042,553 | 7/1962 | Kearney et al. | 134/109 |
| 3,746,023 | 7/1973 | Smith | 134/22.18 |
| 3,785,387 | 1/1974 | Ross | 134/104 |
| 4,106,950 | 8/1978 | Grismer | 134/10 |

FOREIGN PATENT DOCUMENTS

| | | | |
|---|---|---|---|
| 2459774 | 7/1976 | Fed. Rep. of Germany | 134/104 |
| 738690 | 6/1980 | U.S.S.R. | 134/22.1 |

*Primary Examiner*—Stephen Marcus

*Attorney, Agent, or Firm*—Burns, Doane, Swecker & Mathis

[57] ABSTRACT

Apparatus and method are disclosed for purging a vehicle tank compartment to permit access for repair, or maintenance without environmental pollution or hazard to workmen entering the tank. In accordance with the invention an elongated cylindrical storage tank is tilted about its horizontal axis, to form a reservoir for purge water. The tank is connectable as by flexible hoses to fill and drain connections for a tank compartment of a truck, rail car, or other bulk liquid vehicle. Purge water is pumped from the storage tank at a level above the lower tilted end of the elongated tank and vapor displaced from the tank compartment by the water is recovered through a vapor recovery system. Desirably, the compartment is filled until it overflows into the vapor recovery line. Water is returned to the storage tank at a position near the upwardly tilted end. The tilted arrangement permits gravity separation and accumulation of minor amounts of light hydrocarbons, such as diesel fuel or gasoline at an upper separation zone formed by the upwardly tilted end. A similar separation zone or volume for accumulation of rust particles, sludge and the like is formed at the lower tilted end. Hydrocarbons lighter than water are flushed from the tilted upper end of the reservoir tank by adding water to the reservoir tank so that it overflows through a line connected to a separator tank. Heavy particles from the lower tilted end are removed through a cleanout line entering near the lower tilted end of the reservoir tank. Water may also be removed from the tank to lower the water level at the upper tilted end to increase the surface area of the separation zone for accumulation of such lighter hydrocarbons.

8 Claims, 5 Drawing Figures

TANK TRUCK PURGING SYSTEM

The present invention relates to method and apparatus for purging residual hydrocarbons from a tank compartment of gasoline or diesel fuel delivery tank truck, rail car, or other bulk liquid delivery vehicle.

More particularly, it relates to a system for purging residual gas or liquid hydrocarbons from such a system to permit safe entry into the tank for repair, maintenance, or the like without pollution of the environment, including air, water or ground.

It is a particular object of the present invention to provide a system in which a fuel compartment of a delivery tank truck, or the like, may be safely purged of residual liquid or gaseous hydrocarbons by flooding the compartment with water from a reservoir or storage tank while simultaneously recovering hydrocarbon vapors from it. The system is particularly characterized by a water storage tank in the form of an elongated cylinder which is tilted along its longitudinal axis. The tilted tank is both a reservoir for recycling purge water and a recovery volume for hydrocarbon liquids or vapors displaced from the tank compartment during purge. Purge water is pumped from the storage tank into the tank truck compartment through a conventional fuel loading arrangement including a supply line and a loading hose connected through valving to the tank compartment. After water completely fills the tank compartment, it overflows through the vapor recovery system into the storage tank. Purge water is then returned for reuse by backflowing it and any entrained fluid hydrocarbons to the storage tank. By tilting the storage tank, hydrocarbons of less specific gravity than water are separated from the purge water in a separation zone having a relatively large surface area at the upper tilted end. At the same time, hydrocarbons having specific gravity greater than water are separated from purge water in another separation zone at the lower tilted end of the tank. This leaves a body of relatively uncontaminated water within the central portion of the tank. Any removed hydrocarbon liquids, sludge, or vapor entrained by the water during purging operations are then removed from the storage tank. At the upper tilted end of the tank, light-end hydrocarbons are removed by over-filling the storage tank with additional water from an outside source to hydraulically pump such hydrocarbons through an overhead drain line connected to a separator. Heavier hydrocarbons, sludge, rust or the like are removed from the storage tank by a cleanout line extending into the other separation zone at the lower tilted end of the tank.

BACKGROUND OF THE INVENTION

In cleaning and repair of tank truck compartments, such as those used to haul diesel fuel, kerosene, gasoline or the like, it is necessary to remove all hydrocarbon vapors and liquids before workers may safely enter the tank compartment. The explosion and asphyxiation hazard to workers or others in the vicinity of an unclean tank require that special precautions be taken to assure that no hydrocarbon vapors (or liquid which might vaporize) be present when work in or on the tank begins. Further, in certain areas environmental considerations require, by federal, or local, laws or regulations, that no hydrocarbon vapors or liquids be discharged into the atmosphere or on the ground. Such environmental controls impose severe restrictions on how such tank compartments can be properly cleaned so that they may be worked on.

Where environmental regulations are not imposed, the tank compartments are simply flooded with a sufficient volume of water to flush all hydrocarbon liquids and vapors out of the compartment. This, of course, is without regard to the environment. Vapors are forced into the atmosphere. Flooding water spills on the ground for eventual evaporation or storm drain carry-off of the hydrocarbons. Alternatively, return water is discharged into a sewage system for ultimate treatment, disposal or evaporation in a normal sewage plant. Such disregard for the environment is no longer permissible in most metropolitan areas. The penalty is either severe fine and imprisonment, or both, for offenders for failure to observe necessary restrictions on air pollution and water or ground pollution. Further, such materials cannot be either deliberately or surreptitiously introduced into a sewage system without incurring liability either to the public generally or to governmental agencies charged with the responsibility for handling such disposal problems. Accordingly, it is economically important that a suitable system be available for rapidly removing hydrocarbon materials from the tank truck compartment and confining those materials so that vapors and liquids are recovered without pollution.

In addition to the necessity for having flushing facilities that will permit safe repair or maintenance of the truck compartment, it is also important that such flushing facilities make economical use of the purge water. Adequate water may be expensive. In some areas water use for such purposes is also legally restricted so that it is important to reuse the wash or purge water. Further, such use should be without recontamination of the tank being cleaned from previously used water. Additionally, a reclamation system permitting such reuse of the purge water must be simple and reliable so that the system is economically attractive.

In accordance with the present invention, the foregoing problems have been solved in a manner that makes them economically attainable with a tank truck compartment flooding and washing system that assures removal of the residual hydrocarbon vapors and/or liquids from the tank with full recovery of vapor and recovery of the wash water with any liquid or entrained hydrocarbons. In accordance with the invention, an elongated, cylindrical water supply tank is tilted a few degrees from horizontal so that purge water carrying such hydrocarbon components into the storage tank are gravity separated. These components, lighter than the specific gravity of water and heavier than the specific gravity of the wash water, are segregated in two separation zones at opposite ends of the tilted tank. In accordance with a preferred method of operating the system, purge water is first withdrawn from the reservoir tank at a region from near the radial center to the lower central portion of the cylindrically elongated, tilted tank and at a location axially toward the upper tilted end. Such water is supplied by a pump, loading pipe, and flexible hose system connected to a valve for the tank compartment through the truck fill system. Water is then pumped into the tank compartment so that it is completely filled. A vapor recovery line is attached to the vapor space of the tank truck compartment so that any vaporized hydrocarbons remaining in the compartment are driven to a hydrocarbon vapor recovery system by water filling the tank compartment. Preferably, but not necessarily, when the tank compartment is completely filled, water overflows through the vapor recovery line to the storage tank. Pumping of purge water from the reservoir is then stopped and the tank compartment is drained back into the storage tank through a line that enters the tank near the radially lower side of the elongated, cylindrical member. In this way, heavy hydrocarbon components of any hydrocarbon compounds are preferentially deposited near the lower separation zone for gravity separation at the lower tilted end. At the same time lighter hydrocarbons float upwardly and then migrate toward the separation zone at the axially upper tilted end of the tank. Preferably, the storage tank is not completely filled so that there is adequate vapor, or head, space above the water surface at the upper tilted end. Such space is then connected by an overflow line to a slop, or hydrocarbon fluid separator recovery, system for recovery or disposal of the light hydrocarbons. They are then flushed from the storage tank by addition of more water from an external, or make-up, water source to fill the tank and force such lighter hydrocarbons out of the upper end. A heavy hydrocarbon cleanout, or sludge removal line, is connected to extend into the lower end of the tilted storage tank for removal of any hydrocarbon or sludge components such as dirt, scale, rust particles and the like. This line also permits control of the volume of the water level in the tank to form an adequate volume for the upper separation zone.

Further objects and advantages of the present invention will become apparent from the following detailed description of preferred embodiments of the invention as shown in the accompanying drawings which form an integral part of this specification.

DESCRIPTION OF THE PREFERRED EMBODIMENTS OF THE PRESENT INVENTION

Figure 1:
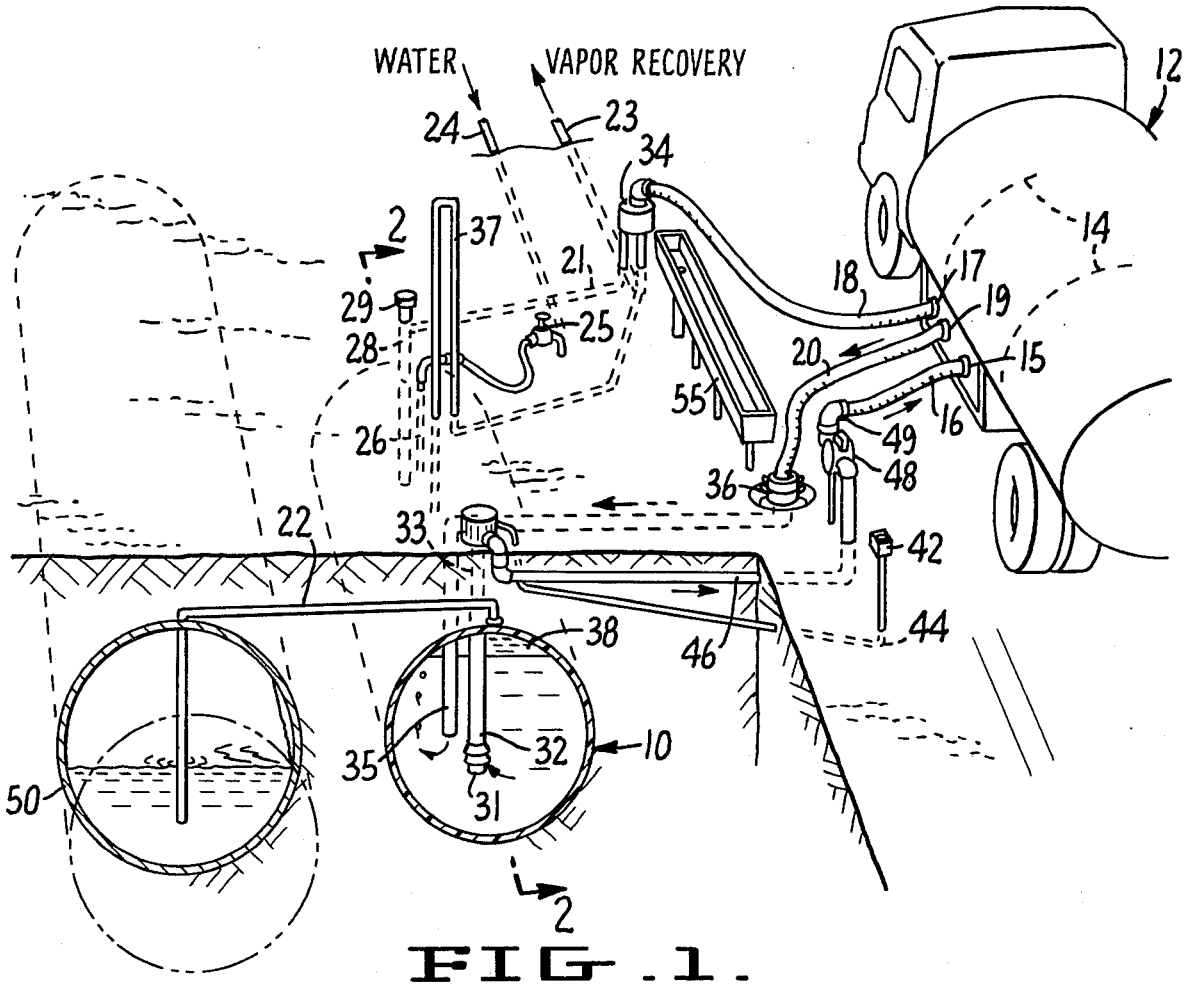
FIG. 1 is a perspective view, partially in vertical cross-section, of a system for practice of the present invention showing a water storage supply tank tilted to the horizontal, a pumping system, and a tank truck having one of its compartments connected for flushing both residual vapors and liquid hydrocarbon components from the compartment, with water recovery into the tilted storage supply tank. The system also includes piping arrangements for removal of liquid hydrocarbon components and other cleanout products returned to and automatically separated in the tilted storage tank for disposal to waste or a hydrocarbon recovery tank.

A tank truck compartment purge system arranged to operate in accordance with the present invention is illustrated in FIG. 1. It will, of course, be understood that substantially all hydrocarbons have been drained from the compartment to be cleaned prior to connection of the purge system to tank truck 12. As shown in FIG. 1, tank truck 12 includes a plurality of compartments 14, each of which is an individual tank suitable for carrying diesel fuel, unleaded gasoline, leaded gasoline or the like. Fuel to be distributed from such compartments is pumped into one of the compartments 14 by way of valve 15 through input or fill hose 16. Discharge from compartment 14 is through valve 19. Valve 19 may provide a common connection to individual compartments 14 through a flexible hose, such as return line or discharge hose 20. Hoses 16 and 20 are normally connected to valves 15 or 19 by quick disconnect means (not shown) which form a fluid tight seal between the valves and the hoses. Similarly, a vapor recovery hose 18 is connectable to a vapor recovery line 23 through truck connector 17.

Figure 2:
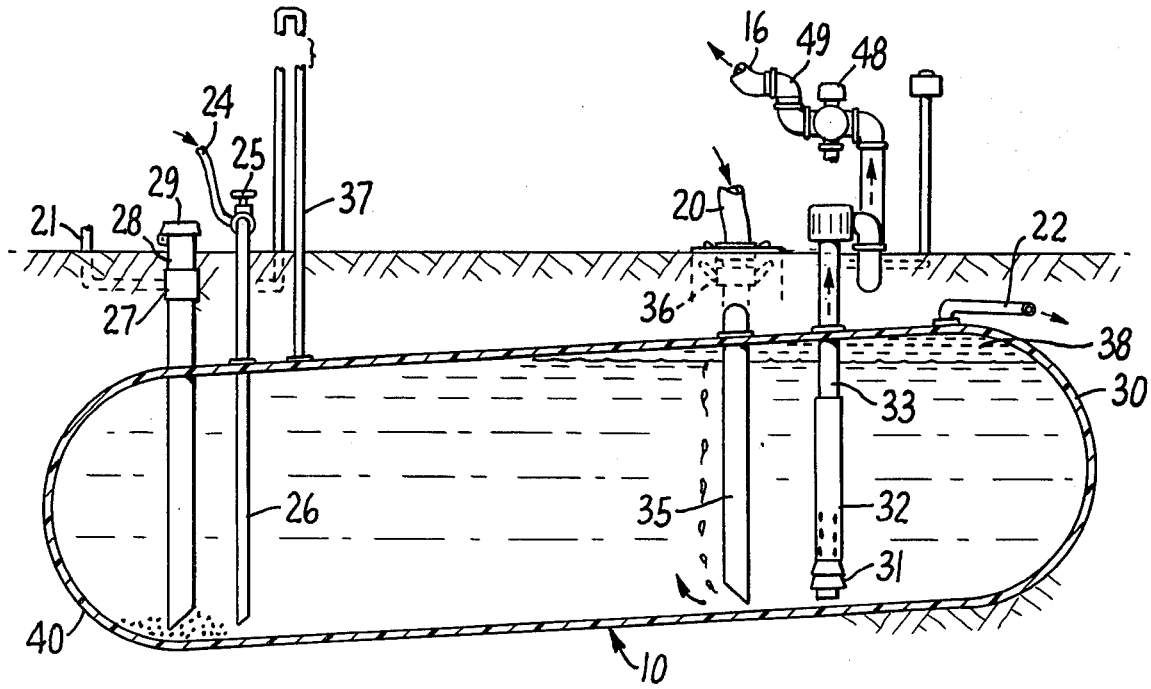
FIG. 2 is a cross-sectional vertical elevation view through the tilted underground storage tank, and flow connections thereto, taken in the direction of arrows 2—2 in FIG. 1.
Figure 3:
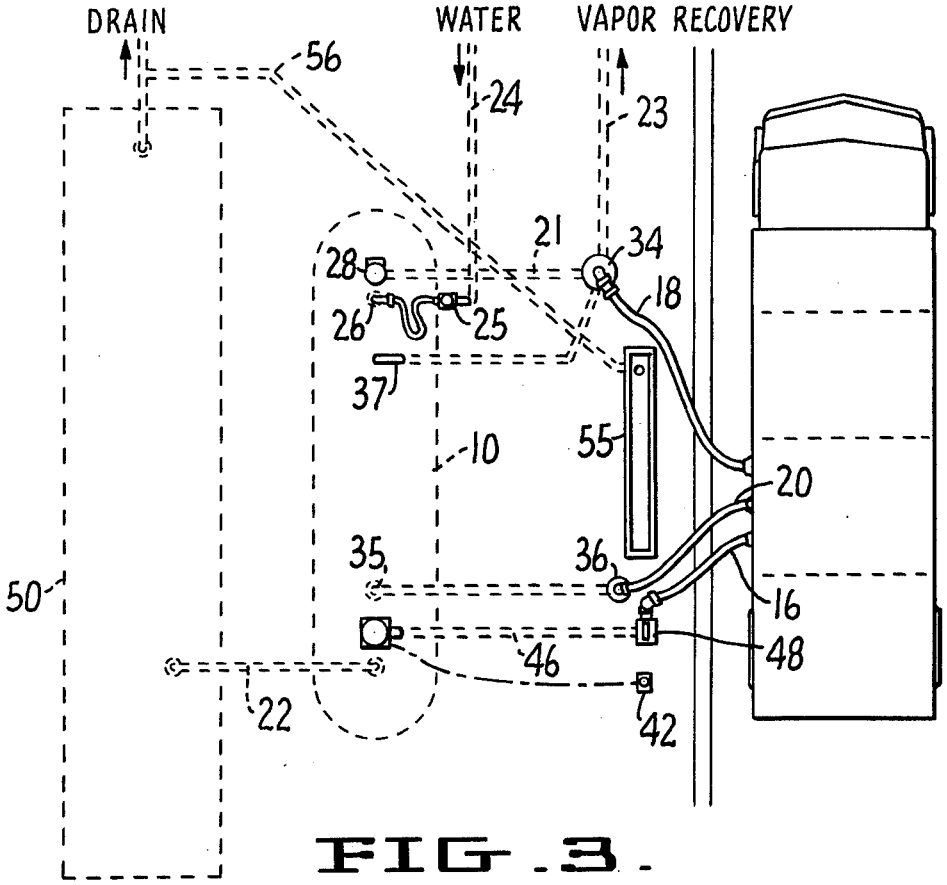
FIG. 3 is a plan-view of the arrangement of FIG. 1, showing in dotted outlines the underground lay out of the storage tank, waste recovery tank, water pumping and drain systems.

In accordance with the present invention, a reusable source of flood water is contained in an underground reservoir or storage tank 10. Most desirably tank 10 is an elongated cylinder tilted slightly toward vertical about its longitudinal axis. This is best shown in FIG. 2. The particular virtue of such an elongated cylinder, tilted as in the present embodiment, lies in its ability to separate light hydrocarbons, that is, those with a specific gravity less than water into a separation zone 38 at the upper tilted end 30 of tank 10. A similar separation zone for accumulation of sludge, rust or other hydrocarbons having a gravity greater than water is at the same time formed at opposite end 40 of tank 10. By such an arrangement intake pipe 33 for purge water to be supplied to compartment 14 may be positioned toward the upwardly tilted end 30 so that intake screen or filter 31 for turbine pump 32 may be positioned radially from near the center to near the bottom wall of tank 10 by intake pipe 33. Similarly purge water is subsequently returned to tank 10 from compartment 14 through hose 20 and return pipe 35. As indicated, connection between hose 20 and pipe 35 is through quick disconnect coupling 36. As will be explained below, generally fill hose 16 and vapor recovery hose 18 will be simultaneously connected to their respective valves 15 and 17 to truck 12. Return hose 20 will be connected to valve 19 only after compartment 14 is filled.

Figure 4:
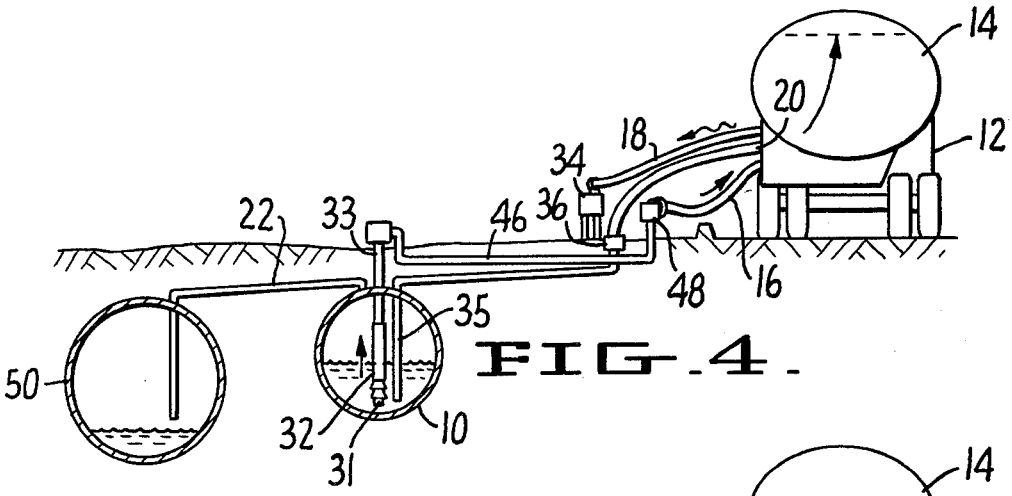
FIG. 4 is an elevation view, partially in cross-section, taken through the storage tank and recovery tank with flow lines connected to fill the tank truck compartment with flushing water.
Figure 5:
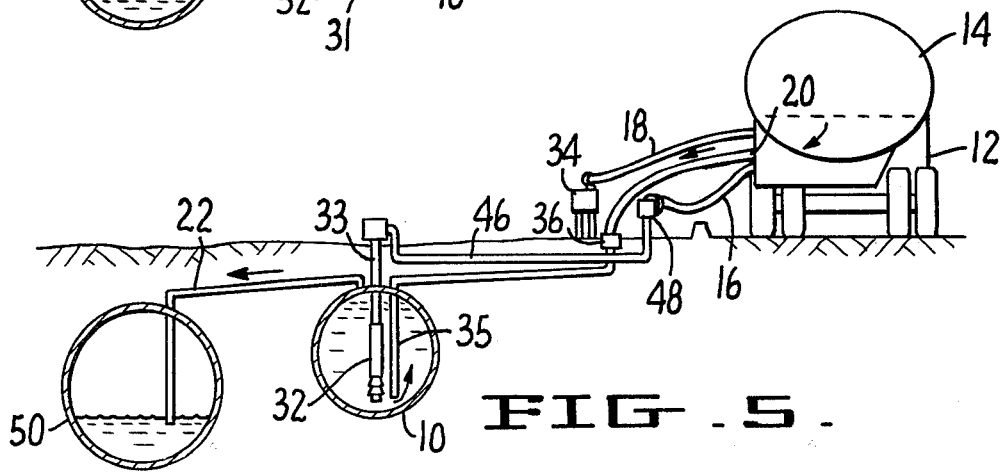
FIG. 5 is a view similar to FIG. 4, indicating draining the tank truck compartment after filling to flush or purge hydrocarbons from the compartment and to displace such hydrocarbons from the storage tank to the slop tank.

Tank 10 also includes a vent line 37 opening into the upper side of tilted tank 10, preferably toward the downwardly tilted end 40. Vent line 37 permits pressure in tank 10 to equalize with atmosphere when water is withdrawn from, or returned to, tank 10. To assure that no hydrocarbon vapor is released in this way, line 37 is connected to vapor recovery system line 23. As best seen in FIGS. 4 and 5, light hydrocarbon separation zone 38 also provides a vapor space at upwardly tilted end 30 when purge water is returned to tank 10. In this way small amounts of hydrocarbons contained in the water are trapped over a relatively large surface area formed by zone 38. Further when this vapor space enlarges, as water is withdrawn from tank 10, vapor line 37 is opened to this space.

Cleanout of tank 10, from time to time will be necessary, due to the return of sludge, rust, particles, or heavy hydrocarbons with purge water from compartment 14. These materials are trapped in a lower separation zone at end 40, also formed by the tilt of tank 10. For this purpose, cleanout line 28 extends to a level near the bottom of tank 10 at lower tilted end 40. An upward extension of pipe 28 is suitably closed by a vapor-tight, hinged cap 29 when pipe 28 is not in use. Pipe 28 may also be used as a vapor recovery connection for vapor line 18. As shown, this is by way of line 21 entering pipe 28 through flange 27. Pipe 28 may be used to lower the level of purge water in tank 10 after removal of lighter hydrocarbons from zone 38 at upper tilted end 30. Pump 32 and pipe 33 may also be used for this purpose.

When light hydrocarbons are trapped, as in space 38, they are suitably removed to a recovery tank, indicated in FIG. 1 as tank 50. Tank 50 may be parallel and substantially larger in volume than tank 10. For example tank 50 may be on the order of 20,000 gallons capacity, whereas purge or storage tank 10 may hold on the order of 5,000 to 10,000 gallons. Flow from tank 10 to tank 50 is by way of overflow line 22 which opens into the upper end of hydrocarbon separator zone 38. To flush hydrocarbons from zone 38, water is supplied to tank 10 by pipe 26 from a makeup water line 24, controlled by valve 25. Sufficient water is added through this means to raise the level in tank 10 to force all hydrocarbons in zone 38 through line 22 and into tank 50.

As noted above, when tank truck 12 is connected to the purge system of the present invention by lines 16 and 20, vapor recovery line 18 will recover hydrocarbon vapors from compartment 14 during tank compartment filling through line 23. Desirably, vapor recovery line 23 is arranged to accept only vapor. Accordingly when tank 14 is filled by purge water from line 15, any excess liquid rising into vapor line 18 is diverted, as by valve 34, to liquid line 21 so that any remaining vapor and such liquid flows into storage tank 10. This vapor is forced downwardly through water in tank 10 and rises into vapor recovery line 37 (through enlarged space 38) and overflow water returns to mix with water in tank 10.

In a preferred form of apparatus embodying the invention, compartment 14 is filled to a given level automatically; that is, electrical power to a drive motor for turbine pump 32 may be supplied by lines 44 through a control mechanism, such as a set-volume switch 42. Purge water pumped from tank 10 through line 33 flows in fill line 46 through a meter 48, arranged to measure the exact quantity of water supplied, to compartment 14 by line 16. Connection between meter 48 and hose 16 is through swivel joint 49. The purpose of the arrangement is to permit set switch 42 to be programmed to supply a given number of gallons to the tank. This volume is generally less than the total volume of the tank compartment. The actual delivered volume to compartment 14 is registered on meter 48 so that the operator may know whether or not the tank is filled in accordance with a presetting of switch 42. Deliberate overfill by a given amount is then completed with valve 34 (or by interchange of hose 18 from vapor line 23 to line 21) sending all fluid (gas or liquid) into tank 10.

Suitably, but not necessarily, a storage trough 55 may be provided for storing flexible hoses 16, 18 and 20 when not connected to valves on truck 12. A drain line 56 may be connected from the bottom of trough 55 to dispose of drips or spills from the hoses into slop tank 50.

From the foregoing detailed description of the apparatus, and as helpfully illustrated in FIGS. 4 and 5, it will be understood that the method of the present invention permits purging residual hydrocarbons from a compartment 14 of a tank truck 12 without pollution of the environment. Compartment 14 is connected through a fill line, such as hose 16, to purge water reservoir 10 and a vapor recovery line 18 is connected to a vapor recovery system through valve 34 and vapor recovery lines 23, or 21. Water is then pumped by turbine pump 32 through line 33, meter 48, swivel 49, hose 16 and valve 15 into a selected tank compartment 14 to be cleaned. Preferably, such water flow is continued into compartment 14 until a set amount of fluid is delivered, usually the normal product filled volume of the compartment. Flow of vapor to vapor recovery line 23 is then diverted to tank 10 by valve 34 and line 21 and compartment 14 is over-filled. At that time valve 15 is closed and with hose 20 connected to valve 19, the latter is opened to permit gravity drain of fill water through hose 20 and line 35 to refill tilted tank 10. Hydrocarbons contained in the purge water are then allowed to separate by gravity in tank 10. Lighter components rise into zone 38 at upwardly tilted end 30 of tank 10 and heavier components settle by gravity into lower tilted end 40. The lighter hydrocarbons, then entrapped by gravity separation in space 38 of elongated, tilted cylindrical tank 10, are hydraulically pumped into hydrocarbon separator 50 by supplying additional water through water makeup line 26. This forces hydrocarbons from zone 38 through line 20 into separator tank 50. The vapor lines 18 and 23, as well as the truck's internal lines, are then preferably cleared of any water by applying compressed air to compartment 14. This exhausts water through hose 18, and line 21 into tank 10. Such air pressure may also be used to force any residual water in compartment 14 back into tank 10.

As noted above, it will of course be understood that the purge system disclosed herein and used in accordance with the present invention is intended to clean only residual amounts of hydrocarbon from product compartment 14. In general, the tanks of truck 12 will have been drained by normal product removal means (not shown), which in general include flexible hoses, such as a product delivery hose similar to drain hose 20. The primary object of the invention is to provide safe working conditions in the compartment before work is undertaken either inside or outside of the tank for repair, replacement or maintenance of the compartment and any interconnected piping.

While only a few embodiments have been illustrated and described in connection with the present invention, various modifications and changes in both the method and apparatus will become apparent to those skilled in the art. All such modifications or changes falling within the scope of the claims are intended to be included therein.

I claim:

1. A method of purging a tank truck compartment of residual hydrocarbon materials to permit safe entry for maintenance, or repair and the like, without hydrocarbon pollution of the environment which comprises forming a finite source of reusable water to purge a tank truck compartment as a horizontally elongated body, tilting said body sufficiently to form upper and lower separation zones at opposite ends of said elongated body, connecting a fill line for said tank truck compartment between said upper and lower zones, of said source of reusable water, and connecting a vapor recovery line for said tank truck compartment to a vapor recovery system, pressurizing water from said source through said fill line to displace hydrocarbon fluid vapor in said compartment toward said vapor recovery line until said water is detected in said vapor recovery line, then returning said water from said compartment to said reusable water source for recovery of said water and any liquid hydrocarbons flowing therewith from said compartment, gravity separating said returned mixture of water and hydrocarbon in said source, recovering hydrocarbon components having a specific gravity less than water from the upper zone at one end of said body by supplying additional water to said source to drive said components at the top of said upper zone out of said end of said body to a hydrocarbon recovery system, and recovering hydrocarbon components having a specific gravity greater than water in said lower zone at the opposite end of said body, whereby water in said source may be reused substantially without recirculation of hydrocarbons entrained therein with said water.

2. The method of claim 1 wherein said vapor recovery line from said compartment is selectively connectable to said vapor recovery system either directly or through said source of reuseable water.

3. A method of purging residual hydrocarbon fluid materials from a mobile vehicle tank to permit safe entry for maintenance, repair or the like, and without hydrocarbon pollution of the environment by such materials which comprises forming a generally cylindrical reservoir of reuseable water to displace residual hydrocarbons from a vehicle tank, said cylindrical reservoir being tilted sufficiently to the horizontal to form upper and lower separation zones at opposite ends of said reservoir, connecting a fill line for said vehicle tank to said reuseable water reservoir at a level intermediate said upper and lower separation zones, pumping water from said reservoir through said fill line to displace hydrocarbon fluids in said tank until said water overflows said vehicle tank, terminating said pumping and then returning said water from said tank to a lower portion of said reservoir for recovery of said water and any hydrocarbon components flowing therewith from said tank, gravity separating said returned mixture of water and hydrocarbon components in said reservoir to separate said component by desity to said upper and lower separation zones at said opposite ends of said reservoir, recovering lighter hydrocarbon components having a specific gravity less than water from said upper separation zone of said reservoir by supplying additional water to said reservoir to drive said lighter hydrocarbon components from one of said reservoir ends to a hydrocarbon recovery line, and recovering heavier hydrocarbon components having a specific gravity greater then water in said lower separation zone of said reservoir whereby water in said reservoir may be reused substantially without recirculation of said heavier or lighter hydrocarbon components in said water.

4. The method of claim 3 wherein a vapor recovery line is connected to said vehicle tank during said pumping and said tank is filled until water overflows therefrom into said vapor recovery line.

5. A method of cleaning a tank compartment of a truck or the like of residual hydrocarbon materials to permit entry by workers for maintenance, repair and the like, without hydrocarbon pollution of the environment or health and explosion hazard to such workers which comprises disposing a generally cylindrical storage vessel with the longitudinal axis thereof at few degrees to the horizontal to form a light hydrocarbon separation zone adjacent the upper end of said vessel and a heavy hydrocarbon component separation zone at the lower end of said vessel with said zones being separated by a central elongated body of cleaning water therebetween, connecting a fill line for said tank compartment to a lower central portion of said elongated body of cleaning water, connecting a vapor recovery line for said tank compartment to an upper central portion of said elongated body, connecting a drain line between a lower portion of said tank compartment and a lower portion of said elongated body, pumping water from said elongated body through said fill line to displace hydrocarbon fluids in said tank compartment toward said vapor recovery line, continuing said pumping until water returns to said elongated body through said vapor recovery line, then returning said water from said tank compartment to said elongated body through said drain line for recovery of said water and any hydrocarbon components flowing therewith from said tank compartment, recovering hydrocarbon components having a specific gravity less than water from said upper separating zone by filling said body with sufficient additional water to drive said components from the top of said upper end of said vessel to a hydrocarbon recovery line, and recovering heavy hydrocarbon components having a specific gravity greater than water from said lower end of said vessel by pumping water and said heavy components from said lower end and then reducing the water level in said body sufficiently to form a vapor space in said vessel above said upper separating zone, whereby said water may be reused with minimum recirculation of entrained hydrocarbon components in said water.

6. The method of claim 5 wherein said vapor recovery line is selectively connectable directly to a vapor recovery system or to a line connected to flow through said upper central portion of said elongated body of cleaning water.

7. Apparatus for purging a vehicle tank compartment of residual liquid and vapor hydrocarbon components to permit access to the interior of said compartment for repair, maintenance and the like without contamination of the environment or safety hazard to persons in the vicinity which comprises an elongated, cylindrical purge water storage tank, said tank having its longitudinal axis tilted relative to horizontal to form at least a pair of gravity separation zones at opposite ends of said tank for mixtures of water and hydrocarbon, an intake pipe member extending into the upwardly tilted end of said tank and below the upper separation zone of said tank, means for connecting said intake pipe to a vehicle tank loading system, said loading system including a loading hose connectable thereto, connection means for engaging said loading hose to a loading valve for a tank compartment on said vehicle, pump means for pumping water from said storage tank through said intake pipe and said loading hose into said compartment, and valve means for selectively controlling flow of purge water from said storage tank to said compartment, a return flow pipe member extending into said storage tank between said separation zones, means for connecting said return flow pipe to a vehicle tank compartment unloading system, said unloading system including a control valve for said compartment and an unloading hose connectable to said control valve, means for recovering hydrocarbon material displaced from said compartment into said purge water storage tank including a source of water, an input line from said source of water extending into said tank below said upper separation zone, an overflow line connected to communicate with said upper separation zone, said overflow line being connected to hydrocarbon recovery means, and a sludge removal pipe connected into said lower separation zone, whereby hydrocarbons with specific gravity less than water may be removed from said tank by overfilling said tank from said source and hydrocarbons with specific gravity greater than water are removable through said sludge pipe, and purge water in said tank may be periodically cycled through a vehicle tank compartment to displace all hydrocarbons therein and thereby permit safe access into said compartment for maintenance, repair and the like thereof.

8. Apparatus in accordance with claim 7 including vapor recovery means connectable between the top of said vehicle tank compartment and said storage tank to permit capture of both vapors and purge water in said storage tank.

* * * * *